US009137614B2

(12) United States Patent
Westerkull et al.

(10) Patent No.: US 9,137,614 B2
(45) Date of Patent: Sep. 15, 2015

(54) BONE ANCHORED HEARING AID WITH ADJUSTABLE RESONANCE DAMPING

(75) Inventors: Patrik Westerkull, Smørum (DK); Bengt Bern, Smørum (DK); Jens T. Balslev, Smørum (DK)

(73) Assignee: OTICON MEDICAL A/S, Smorum (DK)

( * ) Notice: Subject to any disclaimer, the term of this patent is extended or adjusted under 35 U.S.C. 154(b) by 709 days.

(21) Appl. No.: 13/319,658

(22) PCT Filed: Mar. 5, 2010

(86) PCT No.: PCT/EP2010/052806
§ 371 (c)(1),
(2), (4) Date: Dec. 6, 2011

(87) PCT Pub. No.: WO2010/130475
PCT Pub. Date: Nov. 18, 2010

(65) Prior Publication Data

US 2012/0095284 A1 Apr. 19, 2012

(30) Foreign Application Priority Data

May 11, 2009 (EP) ..... 09159877

(51) Int. Cl.
*H04R 25/00* (2006.01)

(52) U.S. Cl.
CPC ..... *H04R 25/606* (2013.01); *H04R 2225/67* (2013.01); *H04R 2460/13* (2013.01)

(58) Field of Classification Search
CPC ..... H04R 2225/67; H04R 2460/13; H04R 25/606; H04R 25/00; A61N 1/36032
USPC ..... 600/25; 381/60
See application file for complete search history.

(56) References Cited

U.S. PATENT DOCUMENTS

| | | | | |
|---|---|---|---|---|
| 3,683,130 | A * | 8/1972 | Kahn | 455/575.2 |
| 2003/0161481 | A1 * | 8/2003 | Miller et al. | 381/60 |
| 2010/0041940 | A1 * | 2/2010 | Hillbratt et al. | 600/25 |

FOREIGN PATENT DOCUMENTS

WO WO 2005/029915 A1 3/2005

OTHER PUBLICATIONS

Håkansson et al., "Skull Simulator for Direct Bone Conduction Hearing Devices", Scand Audiol, vol. 18, pp. 91-98, 1989.
Maxwell et al., "Reducing Acoustic Feedback in Hearing Aids", IEEE Transactions on Speech and Audio Processing, vol. 3, No. 4, pp. 304-313, Jul. 1995.

* cited by examiner

*Primary Examiner* — Christine H Matthews
(74) *Attorney, Agent, or Firm* — Birch, Stewart, Kolasch & Birch, LLP

(57) ABSTRACT

The invention relates to a bone anchored hearing aid with a sound processor which generates a vibration signal and serves the signal at a vibrator for transmission of the vibration signal into the skull bone of a wearer and where a resonance damping system is provided in the hearing aid and comprising an electronic notch filter having a notch filter center frequency F1, wherein the notch filter frequency F1 is below a resonance frequency $F_{sim}$ of the hearing aid as measured in a standard skull simulator.

6 Claims, 2 Drawing Sheets

BONE ANCHORED HEARING AID WITH ADJUSTABLE RESONANCE DAMPING

TECHNICAL FIELD

The present invention relates to a bone anchored hearing aid with adjustable resonance damping. The invention relates specifically to a bone anchored hearing aid with a resonance damping system comprising an electronic notch filter having a notch filter frequency.

The invention furthermore relates to a method for adjusting a center frequency of an electronic notch filter in a bone anchored hearing aid.

BACKGROUND ART

Existing bone anchored hearing aids include a transducer or vibrator that has a resonance frequency F. This frequency is defined as the resonance frequency of the device when it is measured in a standard skull simulator, type TU-1000 (ref: Håkansson B, Carlsson P. Scand Audiol. 1989; 18(2):91-8) To dampen the resonance frequency, the existing bone anchored hearing aids uses an electronic notch filter with a notch frequency F1 that corresponds to the resonance frequency F of the hearing aid transducer. In this way the resonance is dampened and the frequency response becomes more flat.

The existing notch filter damping is practical when measuring the resonance frequency of the bone anchored hearing aid on the skull simulator. The drawback with the existing notch filter damping is that it dampens the resonance at the resonance frequency of the device when it is connected to the skull simulator. The resonance frequency of the vibrator is however not the same on a patients head as on the standard skull simulator, due to the difference in mechanical impedance between a skull simulator and a human head. And in fact there are differences of the mechanical impedance between different patients, so there is a difference in resonance frequency of the transducer when it is connected to different patients.

Since the current bone anchored hearing aids has a notch filter frequency adapted to the resonance frequency on the skull simulator, there will be a less optimal frequency response for the patient when the device is connected to the patient instead.

An example of a prior art bone anchored hearing aid is presented in WO 2005/029915 A1. Here differences between the resonance frequencies from one hearing aid to the other is taken into account, but the differences due to the different properties of patients heads or skull bone structure is not accounted for, and as a result the hearing aid will be better suited for some patients than for others.

DISCLOSURE OF INVENTION

The problem of the prior art is that the resonance frequencies of bone anchored hearing aids may vary from patient to patient due to differences in skull bone structure between patients.

An object of the present invention is to provide a bone anchored hearing aid which has a resonance compensation which is tuned to the individual to which it is attached.

An object of the invention is achieved by a bone anchored hearing aid with a sound processor which generates an output signal and serves the signal at a vibrator for transmission of the vibration signal into the skull bone of a wearer and where a resonance damping system is provided in the hearing aid and comprising an electronic notch filter having a notch filter center frequency F1. According to the invention the notch filter frequency F1 is below a resonance frequency F of the hearing aid as measured in a standard skull simulator.

The notch filter setting gained in this way, ensures that when the hearing aid is connected to the user, the frequency will match the resonance frequency of the hearing aid system when anchored to the skull.

The object of the invention is further achieved by a method for adjusting a center frequency of an electronic notch filter in a bone anchored hearing aid wherein the bone anchored hearing aid is attached to the skull bone of the hearing aid patient who is to wear the hearing aid, and the resonance frequency $F_{real}$ is identified and the notch filter center frequency F1 of the electronic notch filter is adjusted according to the identified resonance frequency Freal.

It is intended that the structural features of the hearing aid system described above, and in the claims can be combined with the method, when appropriate. Embodiments of the method have the same advantages as the corresponding hearing aid systems.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

Figure 1:
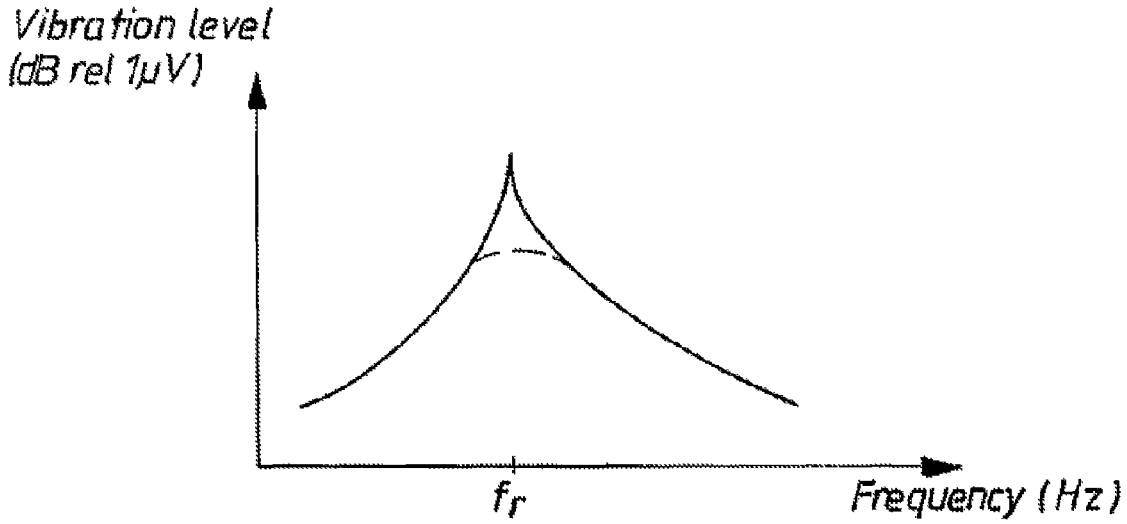
Fig. 1 (Prior art)
FIG. 1 shows a typical frequency response in terms of vibration amplitude versus frequency for a hearing aid vibrator, when the hearing aid is connected to a reference skull.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention is defined by the features of the independent claim(s). Preferred embodiments are defined in the dependent claims. Any reference numerals in the claims are intended to be non-limiting for their scope.

Figure 2:
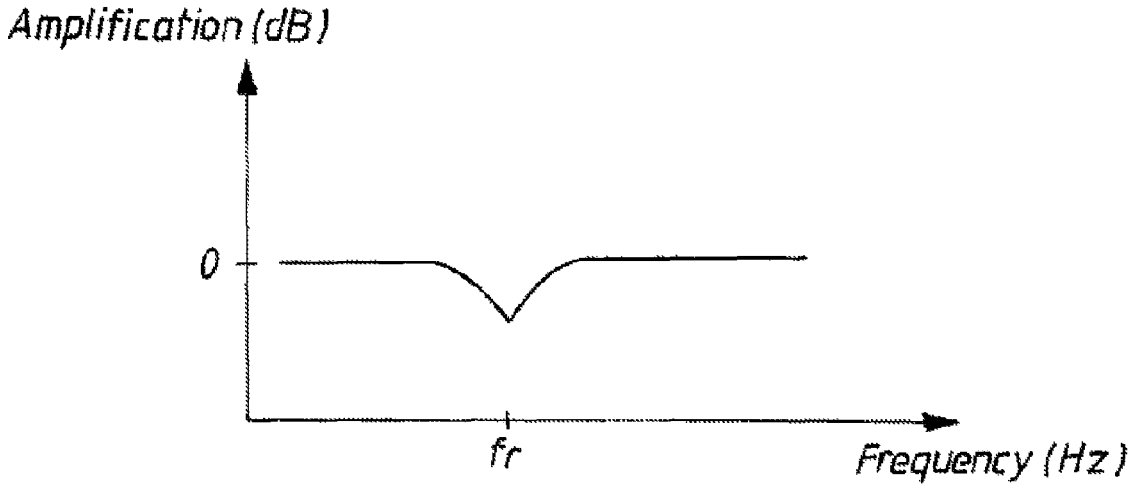
Fig. 2 Prior art
FIG. 2 shows a frequency response of a notch filter.

In FIG. 1 the frequency versus vibration level of a bone anchored hearing aid is disclosed as measured on a reference skull simulator. The frequency Fr is the resonance frequency as measured. In FIG. 2 a notch filter frequency characteristic is shown and the notch filter is adjusted to have a centre frequency Fr corresponding to the resonance frequency measured according to FIG. 1. When the notch filter is applied in the signal processing path of the bone anchored hearing aid a more flat frequency response will be ensured under the precondition that the frequency response of the hearing aid is the same when mounted on the real skull of the user as when mounted on the reference skull. This is however not always the case. The skull bone structure varies from person to person and as also the position of the implanted mounting screw may differ which leads to a significant difference in the impedance which the hearing aid has to drive when providing the vibrational input to the skull of a user.

Figure 3:
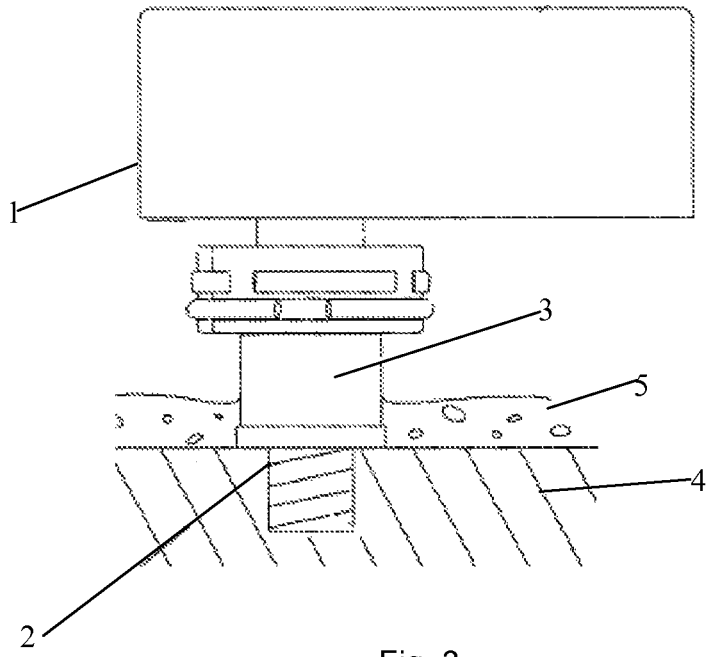
FIG. 3 shows a hearing aid according to the invention and connected to the skull bone of a wearer

In FIG. 3 a schematic representation of a bone anchored hearing aid according to the invention is presented. The hearing aid comprise a vibrator and electronics casing 1 which encloses a vibrator (not shown in detail) and driving electronic parts such as a battery a microphone and a signal processing part. The vibrator is releasably connected to an abutment 3 which penetrates the skin 5 and is anchored into the skull bone 4 by means of a bone integrated screw 2.

Figure 4:
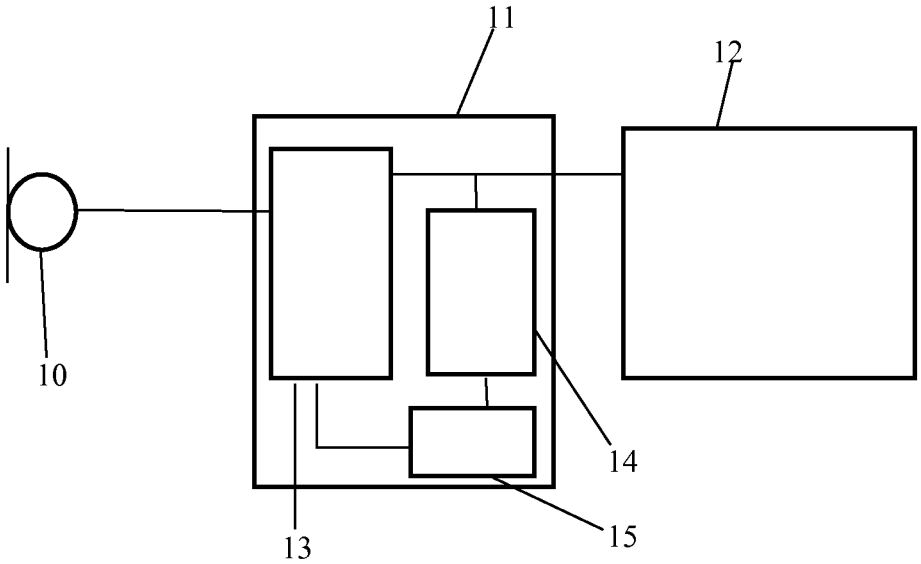
FIG. 4 shows a functional block diagram of the various parts of the hearing aid according to the invention The figures are schematic and simplified for clarity, and they just show details which are essential to the understanding of the invention, while other details are left out. Throughout, the same reference numerals are used for identical or corresponding parts.

In FIG. 4 the signal path of the electronic elements is schematically represented. A microphone 10 is connected to a signal processing element 11 and from the signal processing element 11 an output is provided for the vibrator 12.

Among a number of functional parts, the signal processing element 11 comprises a notch filter 13, which is to provide a frequency shaping of the output signal designed to counteract the inevitable resonance frequency which is inherent in the vibrator 12. The notch filter is not disclosed in more detail as the skilled artisan knows well how such a filter may be realised in both the digital and the analog electronic domain.

According to the invention the signal processing element 11 further comprise a means 14 for determining the resonance frequency of the vibrator 12 once it is mounted onto the abutment of the skull bone of a user. This means may be in the form of a program element which will cause the signal processing means to generate a range of signals to the vibrator 12 and at the same time measure the current consumption at each frequency. Once information on frequency and current or power consumption is provided, the resonance frequency is easily calculated, either by direct comparison of the current consumption at each used frequency or by more elaborate interpolations schemes well known in the art. In either case a frequency value $F_{real}$ representing the real measured resonance frequency of the vibrator mounted on the skull bone 4 of the user, will be generated and stored in a memory space 15. The frequency $F_{real}$ is then used in the setting of the notch filter centre frequency F1.

The means for determining the resonance frequency is either a part of the signal processing device as shown in FIG. 4 or it is a part of a fitting device, which is temporarily connected to the hearing aid at a fitting session when the user starts wearing the device. An advantage of having the means for determining the resonance frequency as a part of the signal processing device is that the resonance frequency may be determined each time the hearing aid is turned on, such that possible aging of the hearing aid parts, notably the vibrator may be counteracted by automatic adjustments. Also the implanted screw may loosen itself and become more or less detached from the skull bone, and this may be determined at an early stage as such a loosening will show as a change in the impedance which the vibrator is coupled to.

In another embodiment of the invention the resonance frequency is measured at a reference skull bone, and recorded as $F_{sim}$. The notch filter centre frequency F1 is determined as the measured resonance frequency $F_{sim}$ minus a predetermined value such as a value between 30 and 80 Hz.

REFERENCES

Håkansson B, Carlsson P. Scand Audiol. 1989; 18(2):91-8)

The invention claimed is:

1. A bone anchored hearing aid, comprising:

a processor that performs signal processing, the processor configured to generate an output signal and to provide the output signal to a vibrator for transmitting a vibration signal into a skull bone of a wearer of the bone anchored hearing aid, the processor including a resonance damping system including a programmable electronic notch filter having a notch filter center frequency F1, a resonance frequency determination unit configured to determine a resonance frequency ($F_{real}$) of the vibrator when the vibrator is mounted on the skull bone of the wearer, and an adjusting unit configured to adjust the center frequency F1 of the programmable electronic notch filter based on the determined resonance frequency ($F_{real}$), wherein the processor is configured to determine the resonance frequency ($F_{real}$) and to adjust the center frequency F1 of the programmable electronic notch filter each time the bone anchored hearing aid is powered on.

2. Bone anchored hearing aid as claimed in claim 1, wherein the notch filter center frequency F1 is 30 Hz to 80 Hz below a resonance frequency $F_{sim}$ of the hearing aid as measured in a skull simulator.

3. Bone anchored hearing aid as claimed in claim 1, wherein the processor includes a meter configured to measure current consumption at various vibration frequencies when the hearing aid is anchored to the skull bone of the wearer.

4. Bone anchored hearing aid as claimed in claim 3, wherein the processor includes a tone generator configured to perform a tone sweep in order to determine the resonance frequency $F_{real}$ of the hearing aid when anchored to the skull bone of the wearer, and the processor is further configured to store in a memory unit M of the signal processing device the resonance frequency $F_{real}$ when the resonance frequency $F_{real}$ is determined.

5. Bone anchored hearing aid as claimed in claim 4, wherein the processor is further configured to adjust the center frequency F1 of the notch filter according to the stored resonance frequency $F_{real}$ in the memory unit M.

6. The bone anchored hearing aid as claimed in claim 1, wherein the notch filter center frequency F1 is below a resonance frequency $F_{sim}$ of the hearing aid as measured in a skull simulator.

* * * * *